US006239392B1

(12) United States Patent
Serizawa et al.

(10) Patent No.: US 6,239,392 B1
(45) Date of Patent: May 29, 2001

(54) SWITCH UNIT

(75) Inventors: Yasuyoshi Serizawa; Minoru Kubota; Keizo Nishitani, all of Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/685,796

(22) Filed: Oct. 11, 2000

(30) Foreign Application Priority Data

Oct. 15, 1999 (JP) ..... 11-293693

(51) Int. Cl.[7] ..... H01H 9/00

(52) U.S. Cl. ..... 200/5 R; 200/1 B; 200/6 R; 200/339; 200/302.3

(58) Field of Search ..... 200/1 R, 1 B, 200/4, 5 R, 17 R, 18, 6 R, 6 A, 512, 517, 329, 302.1, 339, 30.23

(56) References Cited

U.S. PATENT DOCUMENTS 4,401,864 * 8/1983 Ichikawa ..... 200/17 R
5,584,380 * 12/1996 Naitou ..... 200/315
5,902,972 * 5/1999 Nestor et al. ..... 200/1 B

* cited by examiner

*Primary Examiner*—Michael Friedhofer
(74) *Attorney, Agent, or Firm*—Armstrong, Westerman, Hattori, McLeland & Naughton, LLP

(57) ABSTRACT

A switch unit is provided, which includes: an operative body being swingingly operably provided; a first contact portion being abuttable on one end portion of the operative body when the operative body is swingingly operated; a second contact portion being abuttable on the other end portion of the operative body when the operative body is swingingly operated; a fulcrum piece extending from a middle portion of the operative body in a direction where the operative body comes into contact with and gets off the first and second contact portions; a fulcrum receiving portion facing the fulcrum piece; an elastic support member to support the operative body in a state that the fulcrum piece and the fulcrum receiving portion have a gap therebetween when the operative body is not operated and to permit the fulcrum piece to approach the fulcrum receiving portion when the operative body is operated.

9 Claims, 5 Drawing Sheets

SWITCH UNIT

BACKGROUND OF THE INVENTION

1. Field of the Invention

The present invention relates to a switch unit to be used for operating various devices such a powerwindow unit mounted on a vehicle such as a motor vehicle.

2. Description of the Related Art

A powerwindow unit up/down-operates a window glass installed at a door trim of a vehicle. Based on an operation signal from a switch unit provided on the door trim, the powerwindow unit drives a motor and so on for up/down-operating the window glass, thereby open and close a window.

The above switch unit has a knob as a operative body which is swingingly operably provided, a printed circuit board, a decorative members to cover the printed circuit board and to make the knob exposed. A first contacting member facing the printed circuit board is provided on one end portion of the knob. A second contacting member facing the printed circuit board is provided on the other end portion of the knob.

Between the first contacting member and one end portion of the knob provided are a returning spring and a pressing pin, which pressing pin presses the first contacting member toward the printed circuit board when one end portion of the knob is pushed toward the printed circuit board. Also, between the second contacting member and the other end portion of the knob provided are a returning spring and a pressing pin, which pressing pin presses the second contacting member toward the printed circuit board when the other end portion of the knob is pushed toward the printed circuit board. On the other hand, each returning spring return the knob in an initial state.

First and second contact portions to face the respective first and second contacting members are mounted on the printed circuit board. And, a supporting axis is laterally provided on a generally longitudinal middle portion the knob.

According to the above-described structure of the conventional switch unit, when one end portion of the knob is pushed toward the printed circuit board, the first contacting member is pressed through the pressing pin and comes into contact with the first contact portion. Then, this first contact portion outputs a signal, for example, to raise the window glass toward the powerwindow unit.

When the other end portion of the knob is pushed toward the printed circuit board, the second contacting member is pressed through the pressing pin and comes into contact with the second contact portion. Then, this second contact portion outputs a signal, for example, to raise the window glass toward the powerwindow unit.

And, when the pushing operation of one end portion or the other end portion of the knob is removed, one end portion or the other end portion of the knob returns to each initial state by means of each returning spring, whereby the output signal from each contact portion stops.

With respect to the above-described conventional switch unit, however, when one end portion of the knob is pressed toward the printed circuit board, the other end portion turns about the supporting axis, while being apart from the printed circuit board. As a result, the other end portion of the knob fairly largely projects over the decorative member.

On the contrary, when the other end portion is pressed toward the printed circuit board, one end portion turns about the supporting axis, while being apart from the printed circuit board. As a result, the one end portion of the knob fairly largely projects over the decorative member.

Accordingly, in the conventional switch unit, the end portions of the knob each have to be thick enough not to make a vertical clearance between each of them and the decorative member, for example, for preventing dust or the like from coming into the switch unit, which requires a relatively large distance between the decorative member and the printed circuit board.

Consequently, the conventional switch unit has a relatively large thickness, which increases a setting space of the unit onto the door trim and restricts a design of the door trim.

Further, the conventional switch unit requires the pressing pin and the returning spring are necessary, which increases the number of parts, thereby lowering the efficiency of assembly work and raising the cost.

SUMMARY OF THE INVENTION

In view of the foregoing, an object of the present invention is to provide a switch unit wherein a thin-modeling is attained thereby to reduce a mounting space thereof and simultaneously a cost reduction thereof is attained.

In order to achieve the above-described object, as a first aspect of the present invention, a switch unit comprises: an operative body being swingingly operably provided; a first contact portion being abuttable on one end portion of the operative body when the operative body is swingingly operated; a second contact portion being abuttable on the other end portion of the operative body when the operative body is swingingly operated; a fulcrum piece extending from a middle portion of the operative body in a direction where the operative body comes into contact with and gets off the first and second contact portions; a fulcrum receiving portion facing the fulcrum piece; an elastic support member to support the operative body in a state that the fulcrum piece and the fulcrum receiving portion have a gap therebetween when the operative body is not operated and to permit the fulcrum piece to approach the fulcrum receiving portion when the operative body is operated.

As a second aspect of the present invention, in the structure with the above first aspect, the switch unit further comprises: a first contacting member provided on the one end portion of the operative body oppositely to the first contact portion; and a second contacting member provided on the other end portion of the operative body oppositely to the second contact portion, wherein the first and second contacting members can be put into contact with the first and second contact portions, respectively, by swingingly operating the operative body.

According to the above-described structures, the elastic support member supports the operative body in a state that the fulcrum piece and the fulcrum receiving portion have the gap therebetween when the operative body is not pushed and permits the fulcrum piece to approach the fulcrum receiving portion when the operative body is pushed.

And, when one end portion or the other end portion of the operative body is pushed toward the first or second contact portion, respectively, the operative body swings about the other end portion or one end portion, respectively, which can reduce upward projection of the other end portion or one end portion of the operative body.

Accordingly, distance between the decorative member and the base can be reduces, which attains thin-modeling of the switch unit itself, thereby reducing a mounting space thereof.

Since the elastically deforming portion returns the operative body to the original position when the pushing operation of the operative body ends, the number of parts can be reduced with its simple structure, thereby reducing the cost of the switch unit.

Further, when the operative body is swung, the operative body is operated, firstly, with relatively weak force till the fulcrum piece reaches the fulcrum receiving portion and, subsequently, with relatively strong force after the fulcrum piece has reached the fulcrum receiving portion. Therefore, the operative body can be operated with almost the same feeling as of the conventional one without giving a driver uncomfortable feeling.

As a third aspect of the present invention, in the structure with the above second aspect, the gap between the fulcrum piece and the fulcrum receiving portion is smaller than a gap between the first contact portion and the first contacting member and also than another gap between the second contact portion and the second contacting member, in a state of the operative body being not operated.

According to the above-described structure, a contact between the first contacting member and the first contact portion and a contact between the second contacting member and the second contact portion do not occur at the same time, whereby a signal to raise a window glass or a signal to lowers a window glass can be securely output to the powerwindow unit.

As a forth aspect of the present invention, in the structure with any one of the above aspects, the switch unit further comprises: a base having the first and second contact portions; and a decorative member to be provided over the base and to make the operative body exposed therefrom, wherein the elastic support member surrounds a periphery of the operative body and makes a clearance between the operative body and the decorative member and another clearance between the decorative member and the base liquid-proof According to the above-described structure, the elastic support member can protect the inside of the operative body and under the decorative member from a liquid such as water, whereby failure of the switch unit can be prevented.

As a fifth aspect of the present invention, in the structure with the above forth aspect, the elastic support member includes: a base portion arranged between the decorative member and the base along a periphery of the operative body so as to make a clearance between the decorative member and the base liquid-proof; a supporting portion to be fitted on the periphery of the operative body; and an elastically deforming portion connecting the base portion and the base portion, and the elastically deforming portion keeps a relative position between the base portion and the supporting portion in a state that the fulcrum piece and the fulcrum receiving portion have the gap therebetween when the operative body is not operated, is elastically deformed upon operation of the operative body while changing the relative position between the base portion and the supporting portion so that the fulcrum piece approaches the fulcrum receiving portion and the one end portion or the other end portion of the operative body comes into contact with the first or second contact portion, respectively, and restores the relative position between the base portion and the supporting portion into a state of the operative body being not operated.

According to the above-described structure, the elastic support member can be easily formed, whereby the cost of the switch unit can be further reduced.

The above and other objects and features of the present invention will become more apparent from the following description taken in conjunction with the accompanying drawings.

DESCRIPTION OF THE PREFERRED EMBODIMENT(S)

An embodiment of the present invention will now be described in further detail with reference to the accompanying drawings.

Figure 1:
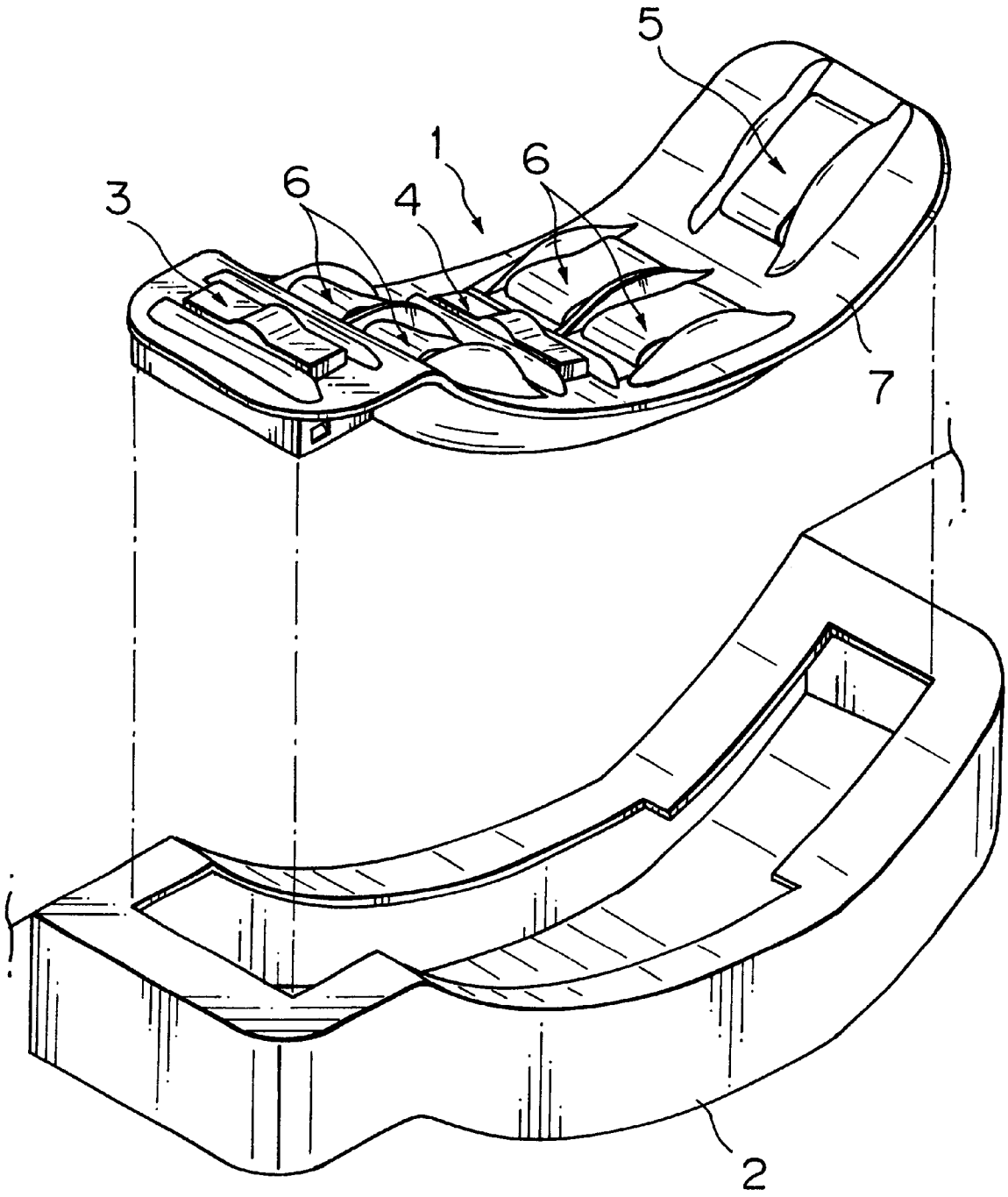
FIG. 1 is a perspective view showing an embodiment of a switch unit in accordance with the present invention.

A switch unit 1 as an embodiment of the present invention is mounted onto an arm rest 2 provided on a driver's seat-side door trim of a vehicle, as shown in FIG. 1.

The switch unit 1 operates a powerwindow unit equipped on a vehicle. The powerwindow unit makes a window glass attached to the door trim go up and down. The switch unit 1 shown in FIG. 1 conducts a going up and down operation of all the window glasses of a vehicle.

Figure 2:
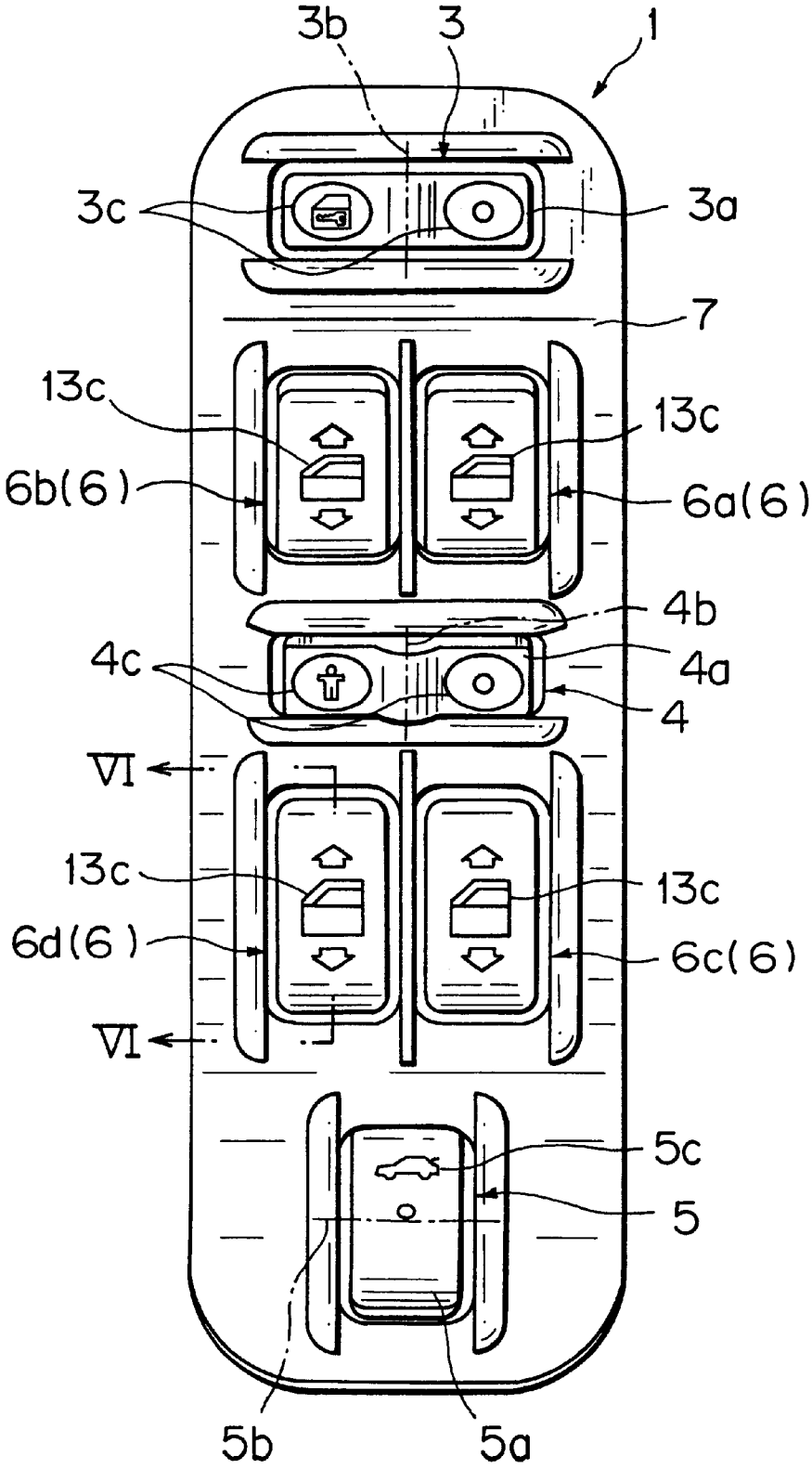
FIG. 2 is a plan view showing the switch unit of FIG. 1.

The switch unit 1, as shown in FIGS. 1 and 2, is equipped with a door locking switch 3, a window locking switch 4, a trunk opening switch 5, a plurality of window switches 6, and a decorative member 7 which exposes these switches 3,4,5,6 for a driver, covers various devices provided inside the switch unit 1, and prevents garbage from invading inside the switch unit 1.

The door locking switch 3 is arranged at the front among the switches 3,4,5,6 in the present embodiment. The door locking switch 3 is formed in a laterally strip-like shape and has a door locking knob 3*a* exposed from the decorative member 7. The door locking knob 3*a* is swingably provided about a supporting axis 3*b* sitting approximately along a longitudinal axis of the switch unit 1.

In the door locking switch 3, for example, when one end portion of the right-side end of the door locking knob 3*a* (FIG. 2) is pushed (or pressed) while swinging about the supporting axis 3*b*, a door locking signal to lock all the doors of the vehicle is output from the door locking switch 3 to a non-shown ECU (Electronic Control Unit) which is mounted inside the door panel so as to lock and unlock the doors.

And, when the other end portion portion, i.e. left side, of the door locking knob 3*a* is pushed while swinging about the supporting axis 3*b*, a door unlocking signal to release the locking of all the doors is output from the door locking switch 3 to the ECU.

The trunk opening switch 5 is arranged at the rear among the switches 3,4,5,6. The trunk opening switch 5 is formed in a longitudinally strip-like shape and has a trunk opening knob 5*a* exposed from the decorative member 7. The trunk opening knob 5*a* is swingably provided about a supporting axis 5*b* sitting approximately along a longitudinal axis of the switch unit 1.

In the trunk opening switch 5, for example, when one end portion, i.e. the front end, of the trunk opening knob 5*a* (FIG. 2) is pushed (or pressed) while swinging about the supporting axis 5*b*, a trunk opening signal to open a trunk of the vehicle is output from the trunk opening switch 5 to a non-shown ECU which conducts opening of the trunk.

The window locking switch 4 is arranged between the door locking switch 3 and the trunk opening switch 5. The window locking switch 4 is formed in a laterally strip-like shape and has a window locking knob 4*a* exposed from the decorative member 7. The window locking knob 4*a* is swingably provided about a supporting axis 4*b* sitting approximately along a longitudinal axis of the switch unit 1.

In the window locking switch 4, for example, when one end portion of the right-side end of the window locking knob 4*a* (FIG. 2) is pushed (or pressed) while swinging about the supporting axis 4*b*, a window locking signal to lock all the window glasses in a closed state is output from the window locking switch 4 to a non-shown ECU which conducts locking and unlocking of the window glasses.

And, when the other end portion portion, i.e. left side, of the window locking switch 4 is pushed while swinging about the supporting axis 4*b*, a window unlocking signal to release the locking of all the window glasses is output from the window locking switch 4 to the ECU.

The above knobs 3*a*,4*a*,5*a* are provided with respective patterns 3*c*,4*c*,5*c* to indicate an operation state of each of the switches 3,4,5 to a driver.

A plurality of window switches 6 are provided correspondingly to the respective window glasses. As shown, a first window switch 6*a* to up/down-operate the window glass near the driver's seat, a second window switch 6*b* to up/down-operate a window glass near an assistant's seat, a third the window switch 6*c* to up/down-operate a window glass near a rear-right seat, and a fourth window switch 6*d* to up/down-operate a window glass near a rear-left seat are provided.

And, the above first and second window switches 6*a*,6*b*, are arranged laterally, i.e. in a vehicle's width direction, in parallel each other and are arranged between the door locking switch 3 and the window locking switch 4.

The above third and fourth the window switches 6*c*,6*d*, are also arranged laterally in parallel each other and are arranged between the window locking switch 4 and the trunk opening switch 5.

Hereinafter, since the window switches 6*a*,6*b*,6*c*,6*d* are similar to each other, their structures and the like will be described by using the fourth window switch 6*d* (hereinafter, merely described as "window switch 6").

Figure 3:
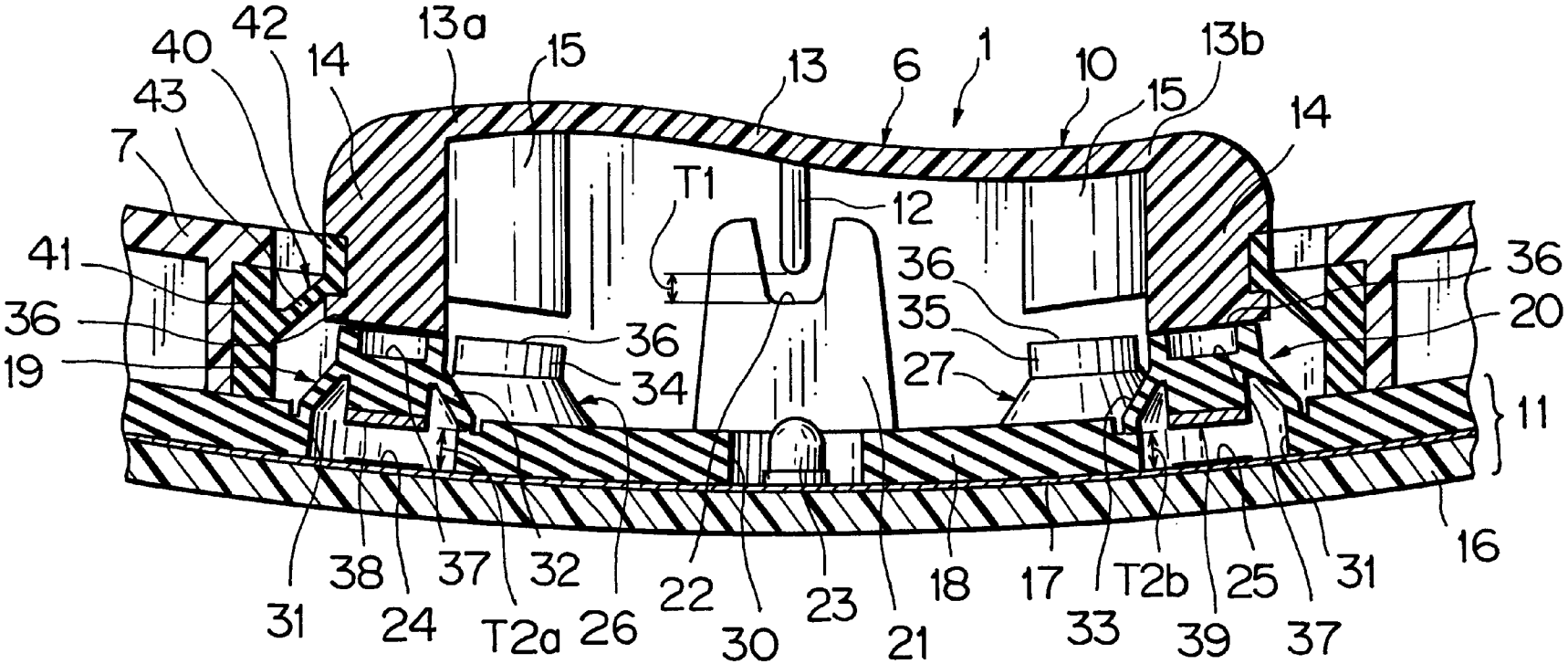
FIG. 3 is a sectional view of a window switch, taken along a line VI—VI in FIG. 2.

The window switch 6 has a knob 10 as an operative body and a base 11, as shown in FIG. 3. The knob 10 has an operating tabular portion 13, which is formed strip-like in a longitudinal direction of a vehicle and operated with a fingertip of a driver, and a pair of first leg portions 14 which extend from one end portion 13*a* (i.e. front side) and the other end portion 13*b*, respectively, to the base 11.

The operating tabular portion 13 of the knob 10 is exposed over the decorative member 7 toward a driver. The operating tabular portion 13 of the knob 10 is provided with a pattern 13*c* on the surface thereof to indicate an operation state of the switch 6 to a driver.

The pattern 13*c* is, for example, transparent, and the other part thereof is opaque black for example. The end portions 13*a*,13*b* of the operating tabular portion 13 are of end portions of the knob 10.

And, a fulcrum piece 12 and second leg portions 15 are integrally formed on the knob 10. The fulcrum piece 12 projects from the inside of the operating tabular portion 13 at a longitudinal middle portion thereof toward the base 11, namely in an on/off direction of later-described first and second contact portions 24,25 with respect to the knob 10. The fulcrum piece 12 is arranged along a width direction of the knob 10.

The second leg portion 15 is provided on each of the end portions 13*a*,13*b* of the operating tabular portion 13. The second leg portions 15 are arranged inside the respective first leg portions 14, namely nearer the fulcrum piece 12. The second leg portions 15 extend from the operating tabular portion 13 toward the base 11.

Figure 4:
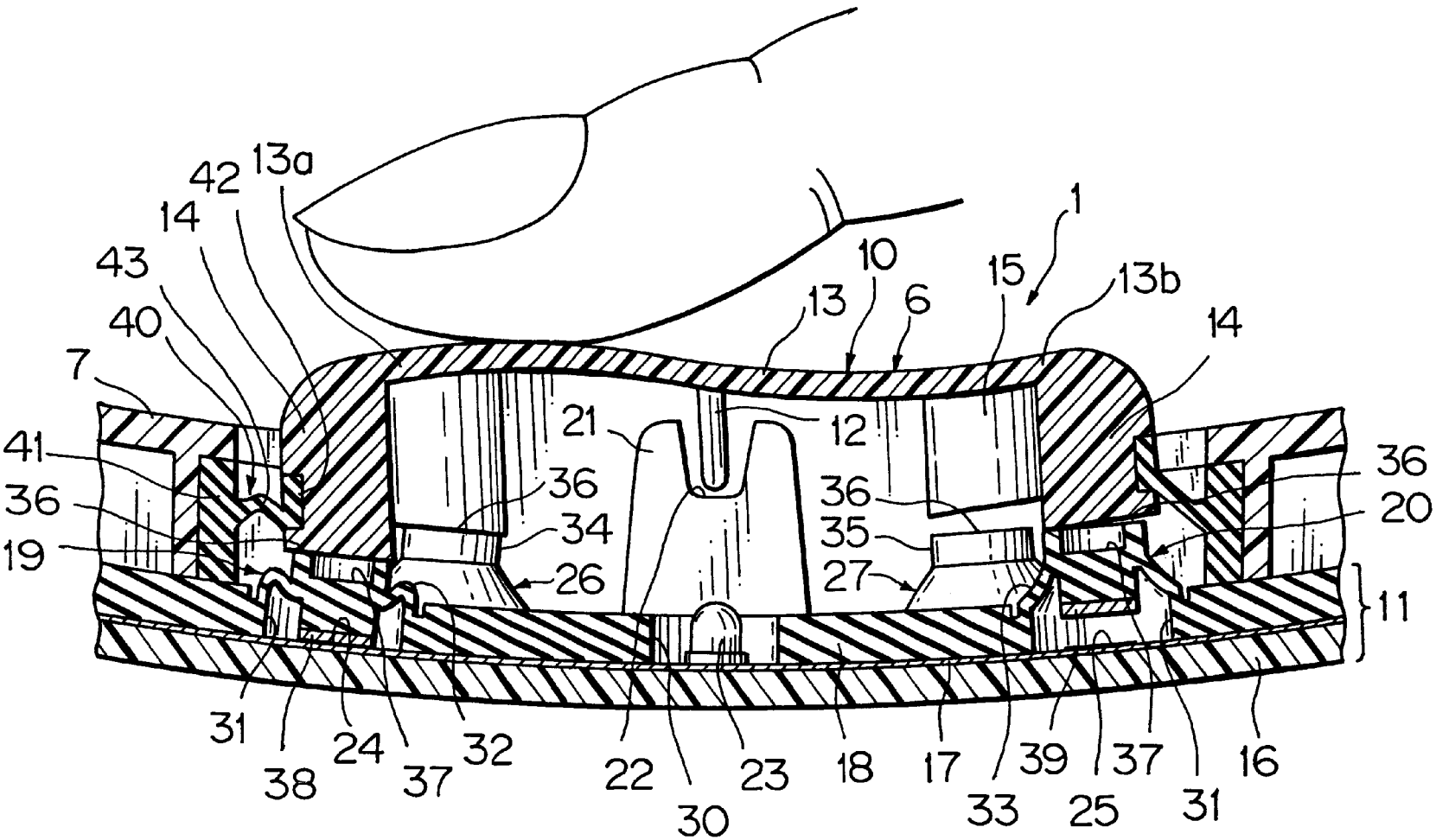
FIG. 4 is also a sectional view of the window switch of FIG. 3, wherein one end portion of a knob has been pushed.

As shown in FIG. 4, when the first and second switch portions 19,20 are pushed toward the base 11 by the first leg portions 14 as described later and then the contact portions 24,25 (later-described) are put into contact with the respective contacting members 38,39, the second leg portions 15 abut on respective end faces 36 of hollow projections 34,35 of third and fourth switch portions 26,27. At this time, a contact portion and a contacting member of each of the third and fourth switch portions 26,27 are kept apart from each other.

The base 11 has a base member 16, a flexible printed circuit (hereinafter FPC) 17, an elastic member 18, a first switch portion 19, a second switch portion 20, the third switch portion 26, and the fourth switch portion 27.

The base member 16 is formed in a plate-like shape. The base member 16 lies under the FPC 17 which lies under the elastic member 18. A pair of fulcrum receiving pieces 21 are integrally formed in parallel on the base member 16 with a gap therebetween.

The fulcrum receiving pieces 21 project toward the fulcrum piece 12 of the operating tabular portion 13 of the knob 10 from the base member 16. The fulcrum receiving piece 21 each are formed in a plate in a longitudinal direction of a vehicle, namely in a longitudinal direction of the knob 10.

The fulcrum receiving piece 21 has each fulcrum receiving portion 22. The fulcrum receiving portion 22 is of a recess which is formed on the top of the fulcrum receiving piece 21. The fulcrum receiving portion 22 receives the fulcrum piece 12, and the knob 10 is capable of turning about an abutting point between the fulcrum piece 12 and the fulcrum receiving portion 22.

The FPC 17 is equipped with a bulb 23, the first contact portion 24 forming the first switch portion 19, the second contact portion 25 forming the second switch portion 20, a non-shown third contact portion forming the third the switch 26, and a non-shown fourth contact portion forming the fourth switch portion 27.

The above bulb 23 is arranged under a central portion of the operating tabular portion 13 of the knob 10 and faces the pattern 13*c*.

The first contact portion 24 is provided under the first leg portion 14 formed on one end portion 13*a* of the knob 10. The second contact portion 25 is provided under the other first leg portion 14 formed on the other end portion 13*b* of the knob 10. The third contact portion is provided under the second leg portion 15 formed on one end portion 13*a* of the knob 10. And, the fourth contact portion is provided under the other second leg portion 15 formed on the other end portion 13*b* of the knob 10.

And, a conduct or pattern is formed on the FPC 17. The conductor pattern supplies electric power to light the bulb 23, and a window glass UP signal to raise the window glass and a window glass DOWN signals to lower the window glass are output from the contact portions 24,25 through the conductor pattern to the above non-shown ECU of the powerwindow unit. And, non-shown openings to receive the fulcrum receiving pieces 21 are formed on the FPC 17.

The elastic member 18 is made of elastic material such as rubber and is formed in a plate. The decorative member 7 is arranged on the elastic member 18.

The elastic member 18 is provided with a bulb exposing hole 30 to expose the bulb 23 and contact point exposing holes 31 to expose the respective contact portions 24,25.

And, hollow projections 32,33,34,35 to form the respective switch portions 19,20,26,27 are formed integrally with the elastic member 18. That is, the hollow projections 32,33,34,35 are formed of the same material as the elastic member 18. The hollow projection 32,33,34,35 are formed in almost the same shape.

Specifically, the hollow projections 32,33,34,35 are in a roughly conical shape. The hollow projections 32,33,34,35 extend from the respective peripheries of the contact point exposing holes 31.

And, the hollow projections 32,33,34,35 have the respective end faces 36 which face the first and second leg portions 14,15. The end faces 36 of the hollow projections 32,33 have respective recesses 37.

The above elastic member 18 covers the FPC 17 in waterproof for protecting the conductor pattern thereof from a liquid such as water. The base member 16, the FPC 17, and the elastic member 18 are common for the switches 3,4,5,6 of the switch unit 1.

The first switch portion 19 faces the first leg portion 14 positioned at one end portion 13*a*. The second switch portion 20 faces the other first leg portion 14 positioned at the other end 13*b*. The third switch portion 26 faces the second leg portion 15 positioned at the one end portion 13*a*. And, the fourth switch portion 27 faces the other second leg portion 15 positioned at the other end 13*b*.

The first switch portion 19 has the hollow projection 32, the first contact portion 24 and the first contacting member 38. The first contact portion 24 and the first contacting member 38 are accommodated inside the hollow projection 32. The first contacting member. 38 is made of a rubber, or the like, having the electroconductivity. The first contacting member 38 faces the first contact portion 24.

Like the above, the first contacting member 38 is provided on one end portion 13*a* of the knob 10. And, when one end portion 13*a* of the knob 10 is pressed toward the base member 16, the hollow projection 32 is pressed by the first leg portion 14 while being elastically deformed, whereby the first contacting member 38 comes into contact with the first contact portion 24.

When the first contacting member 38 comes into contact with the first contact portion 24, the first contact portion 24 outputs the window glass UP signal to the ECU of the powerwindow unit. The window glass continues rising while the fist contacting member 38 is in contact with the first contact portion 24.

The second switch portion 20 has the hollow projection 33, the second contact portion 25 and the second contacting member 39. The second contact portion 25 and the second contacting member 39 are accommodated inside the hollow projection 33. The second contacting member 39 is made of a rubber, or the like, having the electroconductivity. The second contacting member 39 faces the second contact portion 25.

Like this, the second contacting member 39 is provided on the other end portion 13*b* of the knob 10. And, when the other end portion 13*b* of the knob 10 is pressed toward the base member 16, the hollow projection 33 is pressed by the other first leg portion 14 while being elastically deformed, whereby the second contacting member 39 comes into contact with the second contact portion 25.

When the second contacting member 39 comes into contact with the second contact portion 25, the second contact portion 25 outputs the window glass DOWN signal to the ECU of the power window unit. The window glass continues lowering while the second contacting member 39 is in contact with the second contact portion 25.

The third switch portion 26 has the hollow projection 34, the non-shown third contact portion, and a non-shown third contacting member. The third contact portion and the third contacting member are accommodated inside the hollow projection 34. The fourth switch portion 27 has the hollow projection 35, the non-shown fourth contact portion, and a non-shown fourth contacting member. The fourth contact portion and the fourth contacting member are accommodated inside the hollow projection 35.

In a state that the first contacting member 38 and the first contact portion 24 are put into contact each other, when one end portion 13*a* of the knob 10 is further pushed toward the base member 16, the hollow projection 32 is pressed by the first leg portion 14 and is elastically deformed, and simultaneously the hollow projection 34 is pressed by the second leg portion 15 and is elastically deformed.

And, the third contact portion comes into contact with the third contacting member. Thus, the third contact portion outputs an UP signal, which continuously raises the window glass up to the top position, to the ECU of the powerwindow unit. Then, the window glass rises up to the top position.

On the other hand, in a state that the second contacting member 39 and the second contact portion 25 are put into contact each other, when the other end portion 13*b* of the knob 10 is further pushed toward the base member 16, the hollow projection 33 is pressed by the other first leg portion 14 and is elastically deformed, and simultaneously the hollow projection 35 is pressed by the other second leg portion 15 and is elastically deformed.

And, the fourth contact portion comes into contact with the fourth contacting member. Thus, the fourth contact portion outputs an DOWN signal, which continuously lowers the window glass to the bottom position, to the ECU of the powerwindow unit. Then, the window glass goes down to the bottom position.

And, the window switch 6 has an elastic support member 40 made of elastomer such as synthetic rubber or polyethylene resin. The elastic support member 40 is formed generally in a four-sided figure and surrounds the knob 10 along its periphery.

The elastic support member 40 surrounds a periphery of the knob 10 and makes a clearance between the knob 10 and the decorative member 7 and the knob 10 and another clearance between the knob 10 and the base 11 liquid-proof. That is, the elastic support member 40 protects the inside of the knob 10 from a liquid such as water.

And, the elastic support member 40 supports the knob 10 while keeping a gap T1 between the fulcrum receiving portion 21 and the fulcrum piece 12. Also, the elastic support member 40 supports the knob 10 in a state that the gap T1 is smaller than a gap T2*a* between the first contacting member 38 and the first contact portion 24 and also is smaller than a gap T2*b* between the second contacting member 39 and the second contact portion 25.

The elastic support member 40 integrally consists of a base portion 41 arranged between the decorative member 7 and the elastic member 18 so as to make a clearance between them liquid-proof, a knob supporting portion 42 fitted on and over the periphery of the knob 10, and an elastically deforming portion 43 connecting the base portion 41 and the knob supporting portion 42.

The elastically deforming portion 43 keeps a relative position between the base portion 41 and the knob supporting portion 42 in a state that the fulcrum piece 12 and the fulcrum receiving portion 22 have the gap T1 therebetween when the knob 10 is not pushed, namely in a non-operated time of the knob 10.

The elastically deforming portion 43 is elastically deformed when a pushing operation is made on one end portion 13*a* or on the other end portion 13*b* of the knob 10, whereby the fulcrum piece 12 and the fulcrum receiving portion 22 approaches each other and the first or second contact portion 24,25 comes into contact with the first or second contacting member 38,39, respectively.

The elastically deforming portion 43 returns the knob supporting portion 42, namely the knob, to the original position due to the elasticity thereof when the above pushing operation of the knob 10 ends.

When one end portion 13*a*, for example, of the knob 10 is pushed toward the first contact portion 24, though the fulcrum piece 12 approaches the fulcrum receiving portion 22, the other end portion 13*b* of the knob 10 keeps an initial state shown in FIG. 3.

Like this, the knob 10 swings or turns about the other end portion 13*a* which is not pushed when one end portion 13*a* is pushed toward the first contact portion 24.

As described above, the gap T1 is smaller than the gap T2*a* and also than the gap T2*b*.

Figure 5:
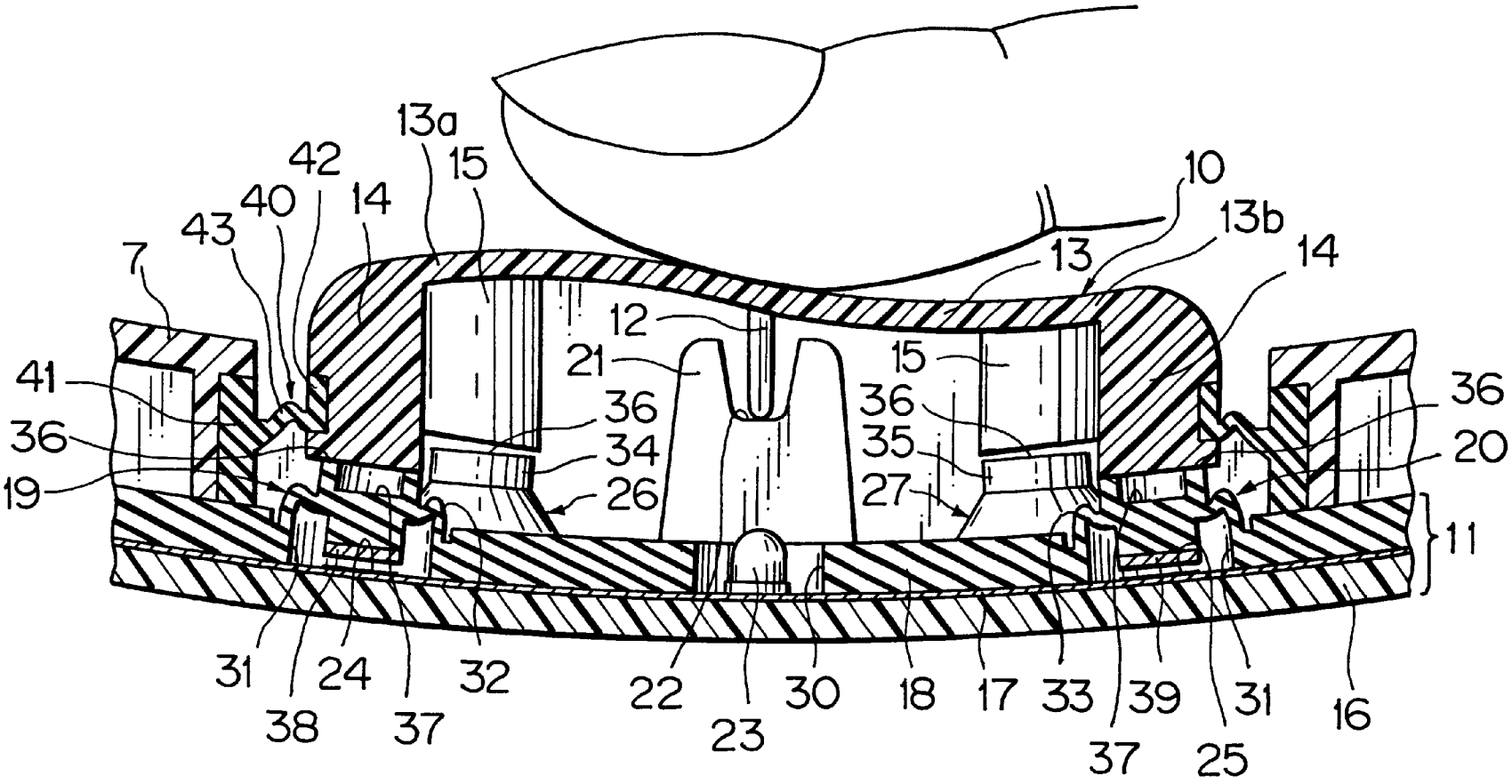
FIG. 5 is further a sectional view of the window switch of FIG. 3, wherein a middle portion of the knob has been pushed.

Therefore, for example, even if the central portion of the knob 10 is vertically pushed so that the fulcrum piece 12 approaches the fulcrum receiving portion 22 as shown in FIG. 5, the first contacting member 38 does not come into contact with the first contact portion 24 and also the second contacting member 39 does not come into contact with the second contact portion 25. That is, a contact between the first contacting member 38 and the first contact portion 24 and a contact between the second contacting member 39 and the second contact portion 25 do not occur at the same time.

The above-described switch unit can also be applied to various switch units for use in a motor vehicle or in other vehicles.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. A switch unit comprising:

an operative body being swingingly operably provided;

a first contact portion being abuttable on one end portion of the operative body when the operative body is swingingly operated;

a second contact portion being abuttable on an other end portion of the operative body when the operative body is swingingly operated;

a fulcrum piece extending from a middle portion of the operative body in a direction where the operative body comes into contact with and gets off the first and second contact portions;

a fulcrum receiving portion facing the fulcrum piece;

an elastic support member to support the operative body in a state that the fulcrum piece and the fulcrum receiving portion have a gap therebetween when the operative body is not operated and to permit the fulcrum piece to approach the fulcrum receiving portion when the operative body is operated.

2. The switch unit as set forth in claim 1, further comprising:

a first contacting member provided on the one end portion of the operative body oppositely to the first contact portion; and a second contacting member provided on the other end portion of the operative body oppositely to the second contact portion, wherein the first and second contacting members can be put into contact with the first and second contact portions, respectively, by swingingly operating the operative body.

3. The switch unit as set forth in claim 2, wherein the gap between the fulcrum piece and the fulcrum receiving portion is smaller than a gap between the first contact portion and the first contacting member and also than another gap between the second contact portion and the second contacting member, in a state of the operative body being not operated.

4. The switch unit as set forth in claim 3, further comprising:

a base having the first and second contact portions; and a decorative member to be provided over the base and to make the operative body exposed therefrom, wherein the elastic support member surrounds a periphery of the operative body and makes a clearance between the operative body and the decorative member and another clearance between the decorative member and the base liquid-proof.

5. The switch unit as set forth in claim 4, wherein the elastic support member includes:

a base portion arranged between the decorative member and the base along the periphery of the operative body so as to makes the clearance between the decorative member and the base liquid-proof;

a supporting portion to be fitted on the periphery of the operative body; and an elastically deforming portion connecting the base portion and the operative body, and the elastically deforming portion keeps a relative position between the base portion and the supporting portion in a state that the fulcrum piece and the fulcrum receiving portion have the gap therebetween when the operative body is not operated, is elastically deformed upon operation of the operative body while changing the relative position between the base portion and the supporting portion so that the fulcrum piece approaches the fulcrum receiving portion and the one end portion or the other end portion of the operative body comes into contact with the first or second contact portion, respectively, and restores the relative position between the base portion and the supporting portion into a state of the operative body being not operated.

6. The switch unit as set forth in claim 2, further comprising:

a base having the first and second contact portions; and a decorative member to be provided over the base and to make the operative body exposed therefrom, wherein the elastic support member surrounds a periphery of the operative body and makes a clearance between the operative body and the decorative member and another clearance between the decorative member and the base liquid-proof.

7. The switch unit as set forth in claim 6, wherein the elastic support member includes:

a base portion arranged between the decorative member and the base along the periphery of the operative body so as to make the clearance between the decorative member and the base liquid-proof;

a supporting portion to be fitted on the periphery of the operative body; and an elastically deforming portion connecting the base portion and the operative body, and the elastically deforming portion keeps a relative position between the base portion and the supporting portion in a state that the fulcrum piece and the fulcrum receiving portion have the gap therebetween when the operative body is not operated, is elastically deformed upon operation of the operative body while changing the relative position between the base portion and the supporting portion so that the fulcrum piece approaches the fulcrum receiving portion and the one end portion or the other end portion of the operative body comes into contact with the first or second contact portion, respectively, and restores the relative position between the base portion and the supporting portion into a state of the operative body being not operated.

8. The switch unit as set forth in claim 1, further comprising:

a base having the first and second contact portions; and a decorative member to be provided over the base and to make the operative body exposed therefrom, wherein the elastic support member surrounds a periphery of the operative body and makes a clearance between the operative body and the decorative member and another clearance between the decorative member and the base liquid-proof.

9. The switch unit as set forth in claim 8, wherein the elastic support member includes:

a base portion arranged between the decorative member and the base along the periphery of the operative body so as to make the clearance between the decorative member and the base liquid-proof;

a supporting portion to be fitted on the periphery of the operative body; and an elastically deforming portion connecting the base portion and the operative body, and the elastically deforming portion keeps a relative position between the base portion and the supporting portion in a state that the fulcrum piece and the fulcrum receiving portion have the gap therebetween when the operative body is not operated, is elastically deformed upon operation of the operative body while changing the relative position between the base portion and the supporting portion so that the fulcrum piece approaches the fulcrum receiving portion and the one end portion, or the other end portion of the operative body comes into contact with the first or second contact portion, respectively, and restores the relative position between the base portion and the supporting portion into a state of the operative body being not operated.

* * * * *